US005416944A

United States Patent [19]

Eriksson

[11] Patent Number: 5,416,944

[45] Date of Patent: May 23, 1995

[54] DEVICE FOR INTERNAL CLEANING AND/OR TREATMENT OF LONG CLOSED CHANNELS

[76] Inventor: Sven Eriksson, Nyponvägen 11, S-691 47 Karlskoga, Sweden

[21] Appl. No.: 196,266

[22] PCT Filed: Feb. 11, 1992

[86] PCT No.: PCT/SE92/00082

§ 371 Date: Feb. 16, 1994

§ 102(e) Date: Feb. 16, 1994

[87] PCT Pub. No.: WO93/03866

PCT Pub. Date: Mar. 4, 1993

[30] Foreign Application Priority Data

Aug. 19, 1991 [SE] Sweden ..... 9102389

[51] Int. Cl.[6] ..... A46B 13/02

[52] U.S. Cl. ..... 15/104.09; 15/1.7; 15/3; 15/52.1; 15/88.4

[58] Field of Search ..... 15/1.7, 3, 104.09, 104.31, 15/340.3, 88.4, 21.1, 52.1; 137/166 C, 167 C, 168 C, 169 C

[56] References Cited

U.S. PATENT DOCUMENTS 3,800,358 4/1974 Ryan ..... 15/104.31 X 5,020,188 6/1991 Walton ..... 134/167 C

*Primary Examiner*—Edward L. Roberts, Jr.

*Attorney, Agent, or Firm*—John Lezdey

[57] ABSTRACT

The present invention relates to a device for cleaning and/or treating elongated closed ducts or channels, particularly ventilation ducts. The device includes an automotive vehicle and mounted thereon a rotary brush useful for cleaning and/or surface treating. The rotary brush is mounted for rotation on a shaft that extends generally at right angles to the longitudinal axis of the duct. The invention also contemplates mounting a television camera onto the automotive vehicle for monitoring results of the cleaning and/or treating operation.

7 Claims, 2 Drawing Sheets

DEVICE FOR INTERNAL CLEANING AND/OR TREATMENT OF LONG CLOSED CHANNELS

The present invention relates to a device for internal cleaning and/or treatment of elongated closed channels, or ducts, preferably ventilation ducts.

It is previously known to clean, for instance, ventilation ducts, or channels, by moving a brush backwards and forwards in the ventilation duct, so as to remove dirt that has adhered to the duct walls. It is also known to inspect such ducts with the aid of an automotive vehicle equipped with an inspection camera. The drawback with these known devices is that they cannot be used simultaneously, and consequently it is not possible to inspect the result of a cleaning operation until the brush has been withdrawn from the duct. If the inspection reveals an unsatisfactory result, it is necessary to reinsert the brush into the duct and carry out a supplementary cleaning operation, this supplementary cleaning operation being effected by "guess work" with the guidance of what was revealed by the inspection.

The object of the present invention is therefore to provide a novel duct cleaning device which will enable the duct to be inspected during a duct cleaning operation and a supplementary cleaning operations to be carried out when so necessary.

The object of the invention has been realized with a device having the characteristic features set forth in the following Claims.

Figure 1:
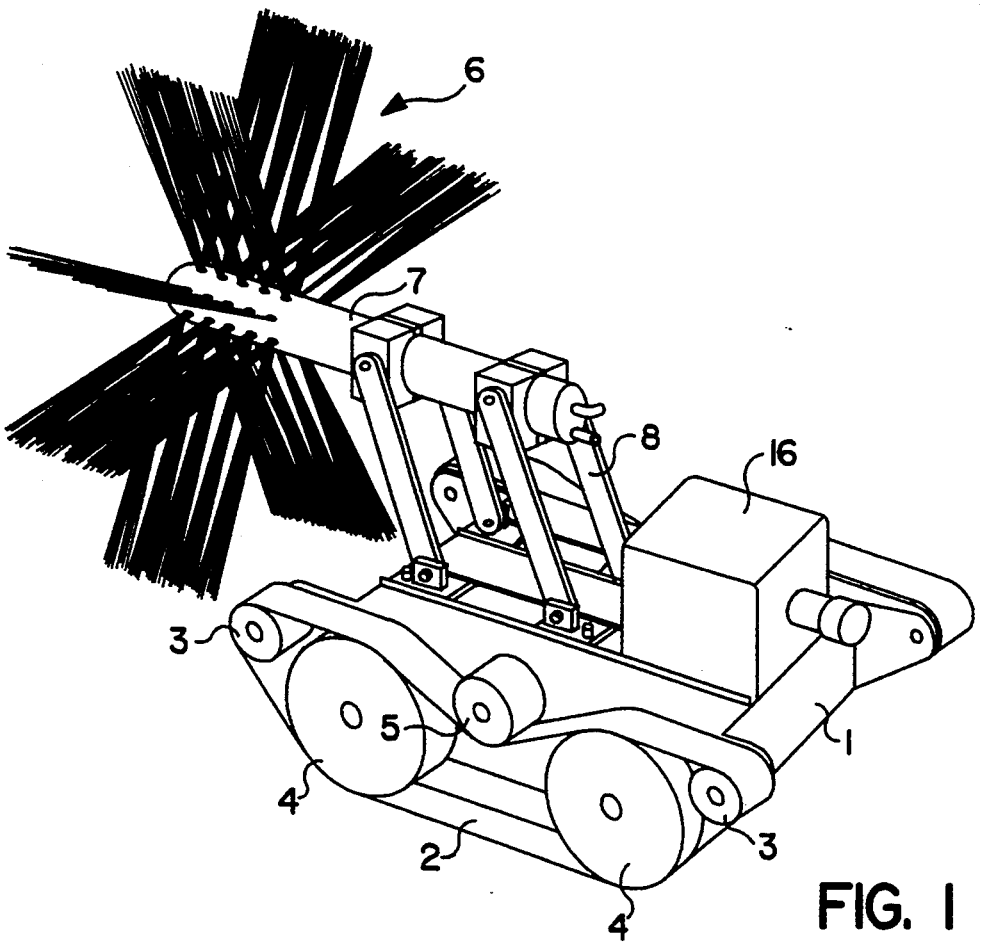
Figure 2:
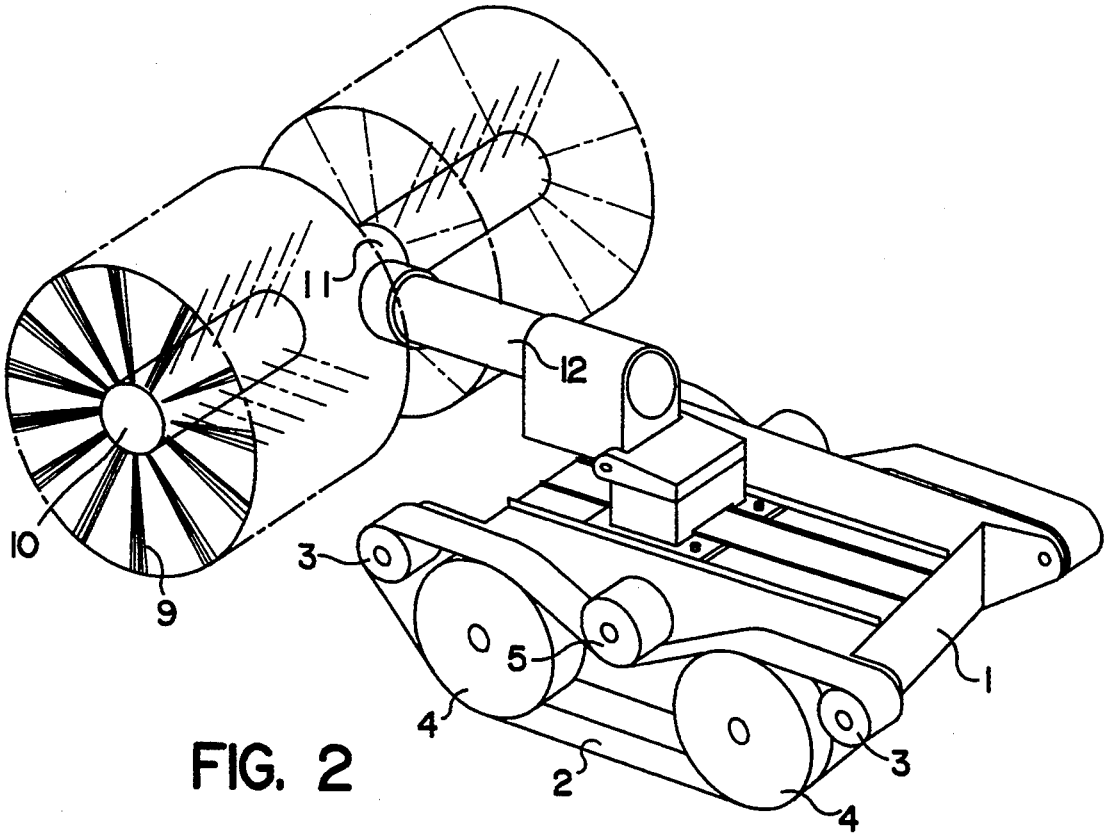
Figure 3:
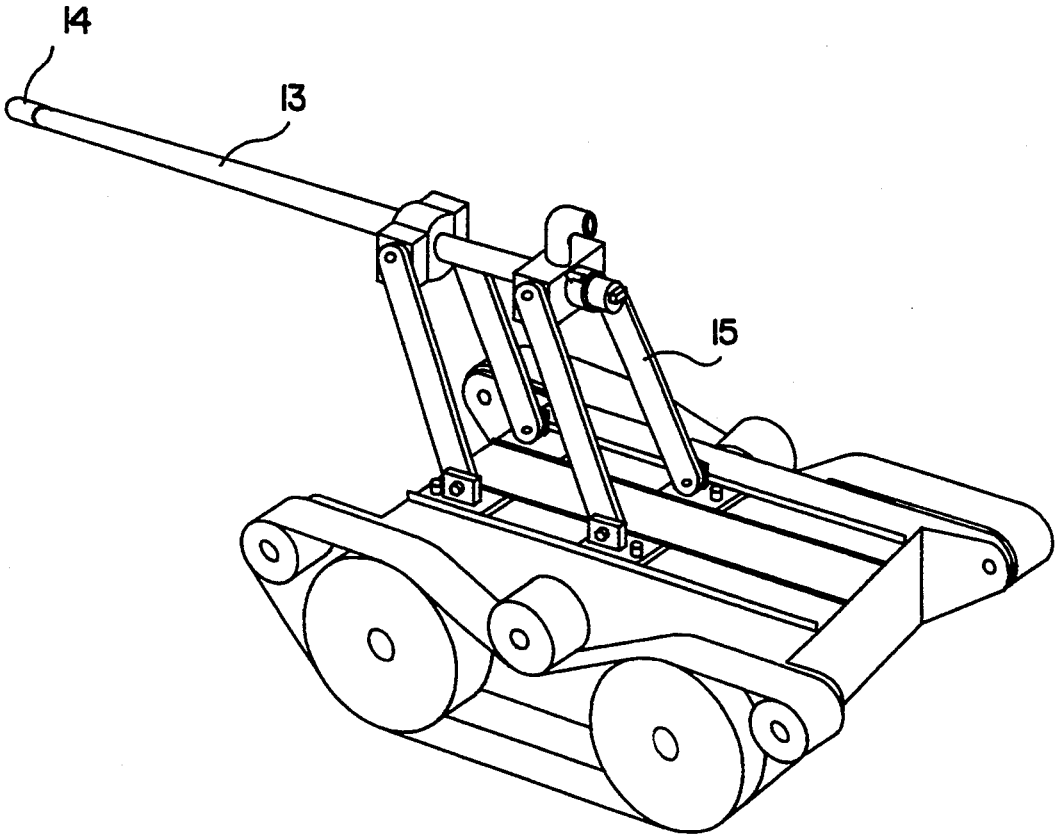

The invention will now be described in more detail with reference to a non-limiting exemplifying embodiment thereof illustrated in the accompanying drawings, in which FIG. 1 is a schematic perspective view of an inventive device equipped for the internal cleaning of ducts of round internal cross-section;

FIG. 2 is a schematic perspective view of an inventive device equipped for the internal cleaning of ducts having a square internal cross-section; and FIG. 3 is a schematic perspective view of an inventive device equipped for the internal surface treatment of a duct.

The inventive device illustrated in FIG. 1 is intended for cleaning the internal surfaces of ventilation ducts. The device is primarily intended for cleaning work in which the internal surfaces of a ventilation duct are scraped or brushed clean mechanically and in which the material thus mechanically removed from the duct walls is sucked from the duct by means of a suction device, a vacuum cleaner, connected to an opening in the duct wall.

The device illustrated in FIG. 1 includes an automotive vehicle 1. The vehicle is preferably driven electrically and is connected to an electric power supply and which control means located externally of the duct, via a power and control cable, not shown. The vehicle is equipped with vehicle drive-bands 2 which pass over guide rollers 3 at respective ends of the vehicle. The diameter of the guide rollers 3 is smaller than the diameter of wheels or rollers 4 which support the drive bands 2 and are also positioned on a higher level than the supporting wheels 4. Thus, the drive bands 2 extend obliquely upwards at the ends of the vehicle 1, thereby enabling the vehicle to pass minor obstacles more easily. Respective drive bands 2 are driven by means of a drive wheel 5 mounted in the centre of the vehicle, as seen in the direction of its longitudinal axis, and acting directly on respective drive belts 2.

Various types of cleaning and/or surface treating units can be fitted to the vehicle 1, in accordance with requirements and also in accordance with the configuration and construction of the duct concerned.

The vehicle 1 of the FIG. 1 illustration is fitted with a cleaning unit in the form of a rotatable brush 6. The shaft 7 around which the brush 6 rotates extends generally in the same direction as the longitudinal axis of the vehicle 1 and also in the direction of the longitudinal axis of the duct to be cleaned. The brush 6 is therewith intended for cleaning a duct of internal round cross-section. The brush 6 is driven by compressed air, which can be delivered through a brush connection for rotation of said brush. The brush 6 is fitted to the vehicle 1 by means of a stand structure 8. The stand structure 8 is constructed in a manner which will enable the brush shaft 7 to be adjusted to different heights in relation to the vehicle 1, thereby enabling the brush to be adapted to varying diameters of the ducts to be cleaned.

FIG. 2 illustrates an embodiment of a cleaning unit intended for cleaning ducts of square internal cross-section. This unit includes a brush 9 which is rotatable about a shaft 10 which extends transversely to the duct axis and thus also transversely in relation to the vehicle 1. Fitted in the centre of the transverse shaft 10 is a gear 11 by means of which the shaft is connected to a drive shaft 12 which extends in the longitudinal direction of the vehicle and which is rotated by compressed air. Similar to the brush 6, the brush 9 may be mounted on a stand structure which will allow the height of the brush to be adjusted in relation to the vehicle 1. By suitable selection of the size of the brush 9 or by suitable adjustment to its height in the duct, the bristles of the brush can be caused to sweep against the duct walls as the brush rotates and therewith tear lose dirt that has adhered to the duct walls.

As before mentioned, FIG. 3 illustrates an inventive device intended for treating the internal surfaces of ducts. The vehicle 1 is fitted with a tubular member 13 which extends in the direction of the longitudinal axis of the vehicle and which is provided at its outermost end with a spray nozzle 14 by means of which liquid delivered to the tubular member 13 can be sprayed onto the duct walls. The tubular member 13 is conveniently mounted on a stand structure 15 which enables the tubular member to be adjusted to different heights in relation to the vehicle 1 and also in relation to the duct dimensions. The liquid is delivered to the tubular member 13 by means of a hose (not shown) which is drawn along by the vehicle as it moves in the duct. This surface treatment may, for instance, involve spraying a cleaning liquid onto the duct walls or spraying paint or lacquer onto the internal surfaces of the duct walls subsequent to cleaning the duct.

As shown in FIG. 1, in addition to the brush 6, the vehicle 1 also carries a TV-camera 16 which is connected by means of a cable to the vehicle control means and the cleaning and/or treating unit. The TV-camera 16 is suitably pivotal through 180°. The TV-camera enables the result of a cleaning or surface treatment operation to be inspected and monitored directly and, when necessary, the vehicle can be stopped and moved backwards to a duct section that has been missed or not cleaned adequately. Although not shown, the units shown in FIGS. 2 and 3 will also normally include a TV-camera 6.

Although not shown in the drawings, in addition to the TV-camera 16, the vehicle 1 may also be equipped with a lamp which will enable the result of a cleaning and/or surface treatment operation to be seen more easily.

Alternatively, instead of a TV-camera, the vehicle may be equipped with some other comparable device which will enable the result of a duct cleaning and/or surface treatment operation to be readily inspected and monitored.

I claim:

1. In a device for internally cleaning elongated closed ducts and channels, including an automotive vehicle, a rotary brush mounted thereon, means for rotating the rotary brush and viewing means mounted on the vehicle for monitoring the result of a cleaning operation, the improvement comprising the rotary brush being mounted for rotation on a shaft which extends generally at right angles to the longitudinal axis of the duct.

2. A device according to claim 1, wherein the rotary brush is mounted on the vehicle by means of a raisable and lowerable stand structure.

3. A device according to claim 2, wherein the vehicle is driven electrically and wherein the means for rotating the rotary brush is compressed air.

4. A device according to claim 1 wherein the vehicle is a band-driven vehicle.

5. A device according to claim 4, wherein the vehicle drive bands are guided upwards over guide rollers at respective ends of the vehicle, and wherein the diameters of the guide rollers are smaller than the diameters of band-supporting rollers, and wherein the guide rollers are positioned at a higher level than the band-supporting rollers so that the drive bands at respective ends of the vehicle have an obliquely and upwardly directed run which enables the vehicle to pass minor obstacles more easily.

6. A device according to claim 1 wherein the viewing means is a TV-camera.

7. A device according to claim 1 further comprising a suction device connected to an opening in the duct wall for removing material loosened by the rotary brush.

* * * * *